US006818370B2

(12) United States Patent
Uchinokura et al.

(10) Patent No.: US 6,818,370 B2
(45) Date of Patent: Nov. 16, 2004

(54) TONER FOR DEVELOPING ELECTROSTATIC LATENT IMAGE, TONER CARTRIDGE CONTAINING THE TONER AND IMAGE FORMING APPARATUS

(75) Inventors: Osamu Uchinokura, Numazu (JP); Hiroyuki Fushimi, Numazu (JP); Kohki Katoh, Tokyo (JP); Shinichiro Yagi, Numazu (JP); Toshiki Nanya, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 10/305,191

(22) Filed: Nov. 27, 2002

(65) Prior Publication Data

US 2003/0162115 A1 Aug. 28, 2003

(30) Foreign Application Priority Data

| | | |
|---|---|---|
| Nov. 30, 2001 | (JP) | 2001-367261 |
| Feb. 1, 2002 | (JP) | 2002-025753 |
| Sep. 20, 2002 | (JP) | 2002-276326 |

(51) Int. Cl.[7] ..... G03G 9/087

(52) U.S. Cl. ..... 430/108.22; 430/109.4; 430/109.2; 430/120

(58) Field of Search ..... 430/120, 108.22, 430/109.2, 109.4

(56) References Cited

U.S. PATENT DOCUMENTS

| | | | | |
|---|---|---|---|---|
| 5,728,501 | A * | 3/1998 | Nakanishi et al. | 430/108.22 |
| 6,360,068 | B1 | 3/2002 | Kinoshita et al. | |
| 6,363,229 | B1 | 3/2002 | Shiraishi et al. | |
| 6,432,589 | B1 | 8/2002 | Uchinokura et al. | |
| 6,432,590 | B1 | 8/2002 | Ueda et al. | |
| 2002/0064723 | A1 * | 5/2002 | Nanya et al. | 430/108.22 |
| 2002/0155366 | A1 * | 10/2002 | Mochizuki et al. | 430/109.2 |
| 2003/0022080 | A1 * | 1/2003 | Fushimi et al. | 430/109.4 |

FOREIGN PATENT DOCUMENTS

| | | | | |
|---|---|---|---|---|
| EP | 495475 | A1 * | 7/1992 | G03G/9/087 |

OTHER PUBLICATIONS

U.S. patent application Ser. No. 10/793,320, Higuchi et al., filed Mar. 5, 2004.
U.S. patent application Ser. No. 10/760,452, Higuchi et al., filed Jan. 21, 2004.
U.S. patent application Ser. No. 10/759,197, Emoto et al., filed Jan. 20, 2004.
U.S. patent application Ser. No. 10/645,804, Tomita et al., filed Aug. 22, 2003.
U.S. patent application Ser. No. 10/670,320, Watanabe et al., filed Sep. 26, 2003.
U.S. patent application Ser. No. 10/114,056, filed Apr. 3, 2002, pending.
U.S. patent application Ser. No. 10/102,629, filed Mar. 22, 2002, pending.
U.S. patent application Ser. No. 09/988,142, filed Nov. 19, 2001, pending.
U.S. patent application Ser. No. 09/993,606, filed Nov. 27, 2001, pending.
U.S. patent application Ser. No. 09/964,622, filed Sep. 28, 2001, pending.
U.S. patent application Ser. No. 10/444,013, Sawada et al., filed May 23, 2003.
U.S. patent application Ser. No. 10/712,026, Tomita et al., filed Nov. 14, 2003.
U.S. patent application Ser. No. 10/193,216, filed Jul. 12, 2002, pending.

* cited by examiner

*Primary Examiner*—Christopher Rodee
(74) *Attorney, Agent, or Firm*—Oblon, Spivak, McClelland, Maier & Neustadt, P.C.

(57) ABSTRACT

A toner for developing an electrostatic latent image, containing a colorant and a binder resin composed of two different resins (A) and (B), wherein resin (A) is substantially free of tetrahydrofuran insolubles, is selected from polyester resins and polyol resins and has such a molecular weight distribution according to gel permeation chromatography that (a) a main peak is present in a molecular weight of 3000 to 9,000 and (b) that portion of resin (A) having a molecular weight of 500 or less accounts for 4% or less based on a total weight of resin (A), wherein resin (B) is substantially free of tetrahydrofuran insolubles and is a polyester resin containing a diol component represented by the formula (1):

(1)

and wherein the weight ratio of resin (A) to resin (B) is in the range of 60:40 to 85:15.

12 Claims, 1 Drawing Sheet

TONER FOR DEVELOPING ELECTROSTATIC LATENT IMAGE, TONER CARTRIDGE CONTAINING THE TONER AND IMAGE FORMING APPARATUS

BACKGROUND OF THE INVENTION

The present invention relates to a toner for developing an electrostatic latent image, to a toner container containing such a toner and to an apparatus for forming images such as a copying machine, a printing machine or a facsimile machine of a single color-, multicolor- or full color-type.

The present day offices are flooded with office electric appliances such as personal computers, printers, copiers, scanners, and facsimile machines. Documents including text documents, graphs etc. are created using personal computers. Moreover, occasion where such documents are printed in color is increasing. Many of the images output by the printers are solid, line, or halftone images. Marketing needs for the image quality are changing accordingly and needs such as high reliability are increasing.

A developer used in an image forming method such as electrophotography, electrostatic recording or electrostatic printing is deposited onto a latent image bearing member, typically a photoconductor. The developer is transferred from the photoconductor to a transfer medium such as a transfer paper and fixed on a surface thereof. Known developers include a two-component developer composed of a carrier and a toner and a one-component developer containing no carrier.

In case of the two-component developer, the carrier is used for charging and transporting the developer in a stable manner. The two-component developer, however, has a problem because the toner particles gradually adhere on the surface of the carrier. Moreover, the concentration of the toner in the developer gradually decreases as only the toner is consumed. Moreover, since the ratio of the toner and the carrier in the developer has to be kept constant, there arises a problem that size of the apparatus becomes large.

The one-component developer is free from the above problems and, therefore, the size of the apparatus can be compact. Hence, the one-component developer is popular and widely used in present day developing systems. The one-component developer can be classified into two types; i.e. a magnetic toner and a non-magnetic toner.

The magnetic toner includes a magnetic material such as magnetite and is held on a developer carrier such as a developing sleeve having a magnet provided therein. The magnetic toner forms a layer on the sleeve with the thickness thereof being adjusted by a suitably thickness control member such as a blade or a roller. The magnetic toner is practically increasingly used recently for small-size printers.

The non-magnetic toner of the one-component developer, on the other hand, is supported on a developing sleeve by electrostatic force. Thus, the non-magnetic toner is supplied to the substrate by being pressed with a supply roller to form a layer thereon. The thickness of the toner layer is adjusted by a suitable thickness control member such as a blade or a roller. Since the non-magnetic toner does not contain a magnetic material which has unavoidably a color, there is obtainable an advantage over the magnetic developer that the non-magnetic toner can be suitably used for color image formation. Moreover, the image forming apparatus that uses the non-magnetic developer does not require any magnet and can be made light-weight and compact and, therefore, is widely used as full color printers.

However, the one-component developer has a lot of problems to be solved. In particular, charging and transportation failures tend to occur when image formation is continuously repeated for a considerably long period of time at a high speed. Namely, as described above, the one-component developer, after it is transported onto the developing sleeve, forms a thin layer by means of the thickness controlling member and is contacted with the latent image on the photoconductor. At that time, contact between the toner and the developing sleeve and between the toner and the thickness controlling member is only for a very short period of time. Therefore, a time for which the toner is charged by friction is very short. As a result, in contrast to the two-component development system using the carrier, more of the toner tends to have a low or opposite charge in the one-component development system. In the non-magnetic one-component system particularly, the toner is transported typically by means of at least one toner transport member. It is known that the thickness of the toner layer on the toner transport member surface must be as thin as possible. When the toner layer is thick, only a portion near the surface of the toner layer is charged and it becomes difficult to evenly charge the whole toner layer. Thus, it is necessary that the toner should be quickly charged to provide the desired level of charging amount.

It is also important that the material constituting the toner supplying member, thickness controlling member and developing sleeve should be suitably selected to provide the one-component, non-magnetic toner with sufficient electric charges. Further, the non-magnetic toner should be forcibly pressed by toner supplying member and thickness controlling member against the developing sleeve so as to sufficiently charge the toner. Under such conditions, however, the toner is heated by friction to cause "toner filming" as a result of melt-adhesion of the toner, in particular the binder resin thereof, on the developing sleeve. The filming results in shortening of the service life of the developing sleeve as well as unstable chargeability of the toner. In addition, the mechanical impact applied to the toner causes grinding thereof, which results in reduction of the density of the images as well as formation of white spots in the images due to failure of proper toner transportation on the sleeve. Thus, the image forming machine is unable to withstand usage over a long period of service, and there is a problem that an image formation unit called a "process cartridge" has to be replaced at an early stage such as every few-thousand copies.

Thermal characteristics of toner, especially a binder resin thereof, also play an important role in image formation. A press heating fixation method has been generally adopted for fixing a toner image on an image receiving sheet such as paper. In such a method, the image-bearing sheet is brought into pressure contact with a heat roll for fixing the image thereon. Since the heating efficiency is high, the fixation of image can be carried out at a high speed. To further improve the fixation speed, it is necessary that the toner should be fixed at a lower temperature, i.e. the softening point of the binder resin of the toner should be low.

At this time, when the temperature of the heat roll is excessively high, the toner is excessively melted and adhered to the heat roll and further transferred to a succeeding transfer sheet (hot offset). For the purpose of preventing the hot offset, an attempt has been made to use a heat roll having a surface made of a releasing property and to apply a releasing agent such as silicone oil to the surface of the heat roll. This method is effective to prevent hot offset when the toner used has low temperature fixability. However, such a toner has a problem because the storage stability thereof is low.

For the production of a full color image, at least three color toner images (cyan, magenta and yellow toner images and, if necessary, a black toner image) are successively formed on a transfer sheet and the superimposed images are fixed simultaneously. Thus, the thickness of the fixed image is unavoidably large. In order to produce clear color images, therefore, a toner for use in full color image forming is required to provide an image with suitable gloss. Further, in order to prevent formation of cracks or delamination of the image, the toner is required to provide an image having suitable fixing strengths.

Properties of the binder resin constituting a toner are main factors of fixation characteristics of the toner. Styrene-acrylate copolymer resins, polyester resins and polyol resins are generally used as a binder resin. It is known that styrene-acrylate copolymer resins are inferior to polyester resins and polyol resins with respect to low temperature fixability and image strength, whereas the polyester resins and polyol resins are apt to cause hot offset. To cope with the hot offset problem of the polyester resins and polyol resins, proposals have been made to increase surface cohesive force thereof in the molten state by increasing the polymerization degree thereof, by introducing crosslinkages thereinto or by introducing gel components. However, these methods adversely affect not only the low temperature fixability but also the pulverizability.

With regard to pulverizability, to meet with increasing requirement for high quality and good half-tone gradation of images, the particle diameters of toners becomes smaller and smaller. Thus, it is important that toner should be produced with good pulverization efficiency. When polyester resins and polyol resins whose molecular cohesive force has been increased are used, a difficulty is caused during pulverization for the production of toners. Further, since the finer the toner particles, the greater becomes the Van der Waal's force, the use of a binder resin having a high cohesive force causes aggregation of the particles and adhesion thereof onto surfaces of a mill. Such aggregation also results in lowering of classification efficiency and an increase of the production costs.

A thought might occur to one ordinary skilled in the art that the pulverizability can be improved by using a binder resin having a reduced molecular weight. However, a reduction of the molecular weight of a resin results in a decrease of the glass transition point thereof, which in turn causes deterioration of the storage stability, anti-blocking property, image strength and anti-offset property of the toner.

Japanese Laid Open Patent Publication No. H2-269364 discloses the use of a polyester resin containing, as a diol component, a polyoxyethylene or polyoxypropylene adduct of bisphenol A as a binder resin of a toner. When such a polyester is used for a full color toner, the image is apt to crack. Further, the low temperature fixability and storage stability of the toner are not satisfactory.

In attempting to improve low temperature fixability of toner, several methods in which two different polyester resins having different properties are used in a toner have been proposed. For example, a method in which a non-linear polyester resin is used in combination with a linear polyester resin (Japanese Laid Open Patent Publication No. S60-90344); a method in which a crosslinkable polyester having a glass transition point (Tg) not lower than 50° C. and a softening point not higher than 200° C. is used in combination with a linear polyester resin having a softening point not higher than 150° C. and a weight average molecular weight (MW) of from 3,000 to 50,000 (Japanese Laid Open Patent Publication No. S64-15755); a method in which a non-linear polyester polymer having a weight average molecular weight not less than 5,000 and a variance ratio (MW/MN) not less than 20 is used in combination with a non-linear polyester polymer having a weight average molecular weight of from 1,000 to 5,000 and a variance ratio not less than 4 (Japanese Laid Open Patent Publication No. H02-82267); a method in which an organic metal compound including a linear polyester resin having an acid value of from 5 to 60 and a non-linear polyester resin having an acid value less than 5 is included in a toner (Japanese Laid Open Patent Publication No. H3-229264); and a method in which a first saturated polyester resin is used in combination with a second saturated polyester resin having an acid value 1.5 or more times the acid value of the first polyester resin (Japanese Laid Open Patent Publication No. H03-41470). Although these binder resins provide good fixation characteristics, such as low temperature fixability, the pulverizability is not fully satisfactory. Further, the known binder resins are ill-suited for use in a one-component type, non-magnetic toner.

SUMMARY OF THE INVENTION

It is, therefore, an object of the present invention to provide a toner suitably used as a one-component, non-magnetic toner for developing an electrostatic latent image.

Another object of the present invention is to provide a toner of the above-mentioned type which shows excellent service life, pulverizability and fixability.

It is a further object of the present invention to provide a toner of the above-mentioned type which can produce high quality color image in a stable manner, without causing background stains or toner filming, for a long period of service.

It is yet a further object of the present invention to provide a toner of the above-mentioned type which permits the use of an image forming apparatus in which toner replenishment can be done by exchange of a toner cartridge rather than exchange of a process cartridge.

It is yet a further object of the present invention to provide a toner cartridge, an image forming method and an image forming apparatus using the above toner.

In accomplishing the foregoing objects, there is provided in accordance with one aspect of the present invention a toner for developing an electrostatic latent image, comprising a binder resin and a colorant, wherein said binder resin comprises different two resins (A) and (B), said resin (A) being substantially free of tetrahydrofuran insolubles, being selected from the group consisting of polyester resins and polyol resins and having such a molecular weight distribution according to gel permeation chromatography that (a) a main peak is present in a molecular weight of 3000 to 9,000 and (b) that portion of said resin (A) having a molecular weight of 500 or less accounts for 4% or less based on a total weight of said resin (A), said resin (B) being substantially free of tetrahydrofuran insolubles and being a polyester resin containing a diol component represented by the formula (1):

(1)

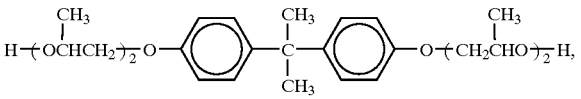

wherein the weight ratio of said resin (A) to said resin (B) is in the range of 60:40 to 85:15.

In another aspect, the present invention provides a toner cartridge containing the above toner.

The present invention also provides an image forming method, comprising developing an electrostatic latent image on an latent image-bearing member with the above toner without using a carrier, said toner being non-magnetic in nature.

The present invention further provides an image forming apparatus comprising a developing unit for developing an electrostatic latent image on an latent image-bearing member with the above toner.

BRIEF DESCRIPTION OF THE DRAWING

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
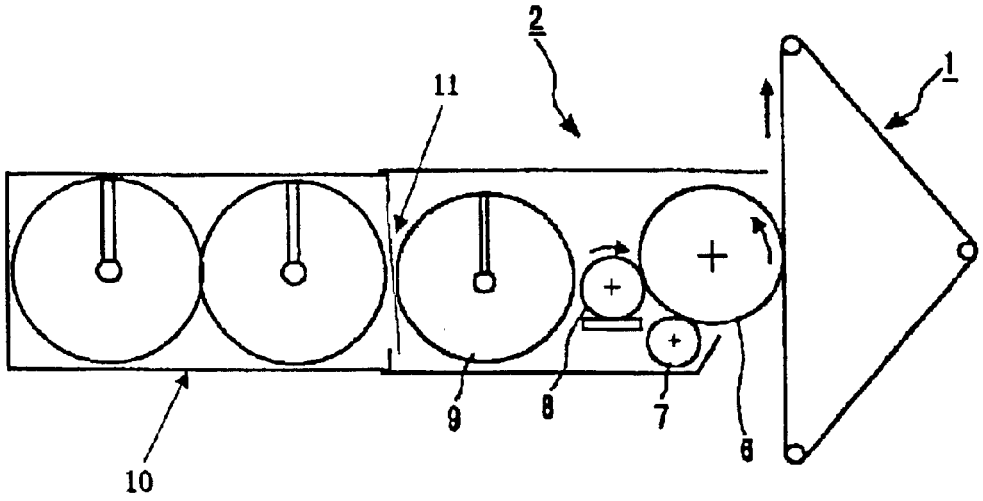
FIG. 1 is a vertical, cross-sectional view diagrammatically illustrating an essential part of an image forming apparatus according to the present invention.

Referring to FIG. 1, an image forming apparatus according to the present invention has an electrostatic latent image-bearing member 1 such as a photoconductor having an electrically conducting support on which a photoconductive layer is supported. The photoconductor is in the form of an endless belt in the specific embodiment shown but may be in the form of a drum. Provided adjacent to the latent image-bearing member 1 is a developing device 2 including a developing sleeve 6, a toner supply roll 8 disposed in contact with the sleeve 6, a thickness controlling member 7 disposed in contact with the sleeve 6 at a position downstream of the toner supply roll 8, and a toner transferring member 9. The developing sleeve 6 may be disposed in contact with the image-bearing member 1 or may be arranged with a small gap being defined therebetween. The toner supply roll 8 rotates in a direction opposite to the developing sleeve 6. The thickness controlling member 7 may be in the form of a cylinder as shown in FIG. 1 or may be in the form of a blade. The cylinder-type thickness controlling member 7 may be rotated continuously or intermittently, or may not be rotatable.

In operation, a toner (not shown) contained in the developing device 2 is agitated by rotation of the toner transferring member 9 and is supplied by rotation of the supply roll 8 to a surface of the developing sleeve 6. At that time, the toner is frictionally pressed against the surface of the sleeve 6 to form a toner layer on the sleeve 6. The thickness of the toner layer is adjusted by the thickness controlling member 7 to form a thin layer which is then fed to a developing zone defined between the sleeve 6 and the latent image-bearing member 1. In the developing zone, a bias voltage is impressed so that the toner on the sleeve 7 electrostatically is transferred to the latent image-bearing member to develop the latent image.

In the image forming apparatus shown in FIG. 1, a toner cartridge 10 is detachably mounted on the developing device 2. Thus, when the toner in the developing device 2 is exhausted, the toner is replenished by exchanging the cartridge 10 with new one containing fresh toner. The cartridge 10 and the developing device 2 are preferably separated by a partition plate 11. The partition plate 11 is preferably so configured as to permit the movement of the toner only from the cartridge 10 to the developing device 2 and to prevent the movement of the toner in the opposite direction.

A toner according to the present invention contains a binder resin and a colorant. The binder resin comprises two different resins (A) and (B).

The resin (A) is substantially free of tetrahydrofuran insolubles and is selected from polyester resins and polyol resins.

Any polyester resin may be used as the resin (A). Polyesters may be obtained by polycondensation of a polyol and a polyacid. The polyol may be a diol or a tri- or more polyhydric alcohol. As the diol to be used for the preparation of the polyester, any diol employed conventionally for the preparation of polyester resins can be employed. Preferred examples include alkylene glycols having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol; and bisphenol A compounds such as bisphenol A, hydrogenated bisphenol A and alkylene oxide adducts of bisphenol A (e.g. polyoxypropylene-bisphenol A adduct). Examples of the polyol having three or more hydroxyl groups include polyhydric aliphatic alcohols having 3 to 20 carbon atoms, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, trimethylolpropane, 1,3,5-trihydroxybenzene and oxyalkylene ether of phenolic novolak. The tri- or more polyhydric alcohol is generally used as a crosslinkage-forming component.

Above all, polyesters containing an alkylene oxide adduct of bisphenol A as a major polyhydric alcohol monomer component are preferably used as the resin (A) for reasons of high glass transition point and, thus, good anti-blocking property and heat resisting preservability (storage stability). Further, the presence of the alkyl groups on both sides of the bisphenol A skeleton serves as a soft segment and image density and image strengths may be improved. Specific examples of the alkylene oxide include ethylene oxide, diethylene oxide, propylene oxide and dipropylene oxide.

The polycarboxylic acid constituting the polyester resin of the resin (A) may be a dicarboxylic acid, tri- or more polybasic carboxylic acid or a mixture thereof. As the dicarboxylic acid to be used for the preparation of the base polyester, any dicarboxylic acid conventionally used for the preparation of a polyester resin can be employed. Preferred examples of dicarboxylic acids include maleic acid, fumaric acid, succinic acid, alkenyl succinic acids (e.g. n-dodecenylsuccinic acid), alkyl succinic acids (n-dodecylsuccinic acid), itaconic acid, adipic acid, sebacic acid, malonic acid, azelaic acid, mesaconic acid, citraconic acid, glutaconic acid, cyclohexanedicarboxylic acid, phthalic acid, isophthalic acid, terephthalic acid, toluenedicarboxylic acid, naphthalenedicarboxylic acid, succinic acid, adipic acid, sebacic acid, malonic acid, lower alkyl esters thereof, and anhydrides thereof. These dicarboxylic acids may have one or more saturated or unsaturated hydrocarbyl groups having 3–22 carbon atoms.

Specific examples of the polycarboxylic acid having three or more carboxyl groups include 1,2,4-benzenetricarboxylic acid, 1,2,5-benzenetricarboxylic acid, 2,5-7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Enbol trimer acid, linoleic acid dimer, anhydrides thereof and alkyl, alkenyl and aryl esters thereof. Specific examples of the alkyl, alkenyl and aryl esters of the above polycarboxylic acid include trimethyl 1,2,4-benzenetricarboxylate, triethyl 1,2,4-benzenetricarboxylate, tri-n-butyl 1,2,4-benzenetricarboxylate, triisobutyl 1,2,4-benzenetricarboxylate, tri-n-octyl 1,2,4-benzenetricarboxylate, tri-e-ethylhexyl 1,2,4-benzenetricarboxylate, tribenzyl 1,2,4-benzenetricarboxylate and tris(4-isopropylbenzyl) 1,2,4-benzenetricarboxylate.

It is preferred that the polyester resin used as the resin (A) have an acid value of 20 mgKOH/g or less, more preferably 5 mgKOH/g or less for reasons of stability of charging of the toner. When the polyester resin has a high acid value, the charging amount becomes high under low temperature and low humidity conditions but becomes low under high temperature and high humidity conditions. As a result, the background stain, image density and color reproducibility vary with the environment and, therefore, it is difficult to obtain high quality images in a stable manner.

Any polyol resin may be used as the resin (A). A polyol resin containing a terminal-capped epoxy resin and a polyoxyalkylene moiety in the main skeleton is preferably used for reasons of stability of charging of the toner against environmental conditions, stability in fixation, stability of the gloss of toner image, reproducibility of color and prevention of curling of the image received sheets. Such a polyol resin may be obtained by reaction of (1) an epoxy resin having glycidyl groups at both termini, (2) an alkylene oxide adduct of a dihydric phenol having glycidyl groups at both termini and (3) a dihalide, isocyanate, diamine, diol, polyhydric phenol or dicarboxylic acid. As the polyhydric phenol, the use of a dihydric phenol is particularly preferred for reasons of stability in the reaction. If desired, the dihydric phenol may be used in conjunction with one or more other polyhydric phenol or a polycarboxylic acid.

The alkylene oxide adduct of a dihydric phenol having glycidyl groups at both termini may be obtained by reacting at least one alkylene oxide (such as ethylene oxide, propylene oxide, butylene oxide or a mixture thereof) with a bisphenol (such as bisphenol A or bisphenol F), followed by glycidylation with epichlorohydrin or β-methylepichlorohydrin. Specific examples of such a glycidylated adduct include glycidyl ethers of the following formula (2):

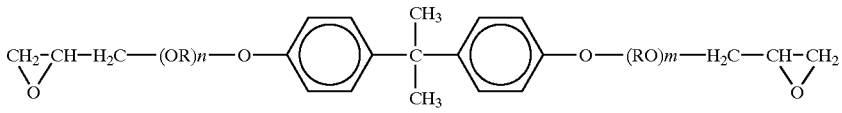

(2)

wherein R represents $—CH_2—CH_2—$, $—CH_2—CH(CH_3)—$ or $—CH_2—CH_2—CH_2—$ and n and m are each an integer of 1 or more with the proviso that (n+m) is from 2 to 6.

It is important that the resin (A) should be free of tetrahydrofuran insolubles and should have such a molecular weight distribution according to gel permeation chromatography that (a) a main peak is present in a molecular weight of 3000 to 9,000 and (b) that portion of said resin (A) having a molecular weight of 500 or less accounts for 4% or less, preferably 1 to 4%, based on a total weight of the resin (A). When the resin (A) contains a tetrahydrofuran insoluble matter, the toner image fails to show suitable gloss and transparency and, hence, high quality images are not obtainable when formed on an OHP sheet. When the content of that portion of the resin (A) having a molecular weight of 500 or less is 4% by weight or less, filming of a developing sleeve, thickness controlling member and photoconductor and formation of very fine particles in a developing device can be effectively prevented. Therefore, the toner can be suitably used as a one-component, non-magnetic system using an exchangeable toner cartridge for toner replenishment. In view of a difficulty in obtaining the resin (A) having a very low content of the low molecular weight portion, the lower limit of the content of that portion of the resin (A) having a molecular weight of 500 or less is generally 1%.

In the present specification, the molecular weight distribution of a resin is measured by gel permeation chromatography (GPC). The gel permeation chromatography is performed as follows: A column is stabilized in a chamber heated to 40° C., through which THF is flowed at a flowing speed of 1 ml/min. Then, 50 to 200 μl of a THF solution of a sample to be measured having a concentration of from 0.05 to 0.6% by weight, is injected into the column with a syringe having a tip end to which a filter unit is connected. Elution is then started to determine the molecular distribution of the sample. Similar operations are performed with respect to several standard polystyrene resins, which have different molecular weights and each of which has a single molecular weight, to prepare a calibration curve. It is preferable to use at least about ten standard polystyrenes to prepare the calibration curve. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes. As a detector, RI is used.

The term "substantially free of tetrahydrofuran insolubles" as used in the present specification is intended to mean that a given resin does not cause clogging of the filter (0.45 μm) connected to the syringe when a THF solution of the resin is injected by the syringe into the column at the time of measuring the molecular weight distribution thereof in the manner described immediately above. Thus, when the filter is clogged, then the resin is regarded as containing a tetrahydrofuran insoluble matter.

The resin (B) used in conjunction with the above resin (A) is substantially free of tetrahydrofuran insolubles and is a polyester resin containing a diol component represented by the following formula (1):

(1)

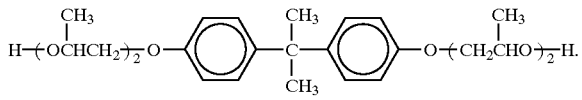

The content of the diol component of the above formula (1) is preferably at least 50 mole %, more preferably at least 80 mole %, most preferably at least 90 mole %, based on the total mole of polyhydric alcohol components constituting the polyester (B). Because of the presence of the resin (B), the toner according to the present invention exhibits good pulverizability while maintaining satisfactory resistance to filming.

The diol component of the above formula (1) may be used in combination with one or more other diols or tri- or more polyhydric alcohols. Such other diols may be those described above with regard to the resin (A). The tri- or more polyhydric alcohols may be, for example, aliphatic polyalcohols, e.g., glycerol, trimethylolethane, trimetylolpropane, pentaerythritol and sorbitol; polyhydric phenols, e.g., triphenol, phenol novolak and cresol novolak; and adducts of polyphenols with alkylene oxides. For reasons of improved resistance to offset and low temperature fixability, the use of phenol novolak or oxyalkylether thereof is preferred. The oxyalkylether of a novolak phenol resin may be obtained by, for example, reacting a novolak phenol resin with a compound containing one epoxy group.

The novolak phenol resin is produced by polycondensation reaction of a phenol and an aldehyde in the presence of a strong acid or alkaline catalyst. More than one phenol or aldehyde may be used. Specific examples of acid catalysts are inorganic acids, such as hydrochloric acid, phosphoric acid and sulfonic acid, and organic acids, such as p-toluene sulfonic acid and oxalic acid. Novolak phenol resins and methods of making the same are well-known, see Encyclopedia of Polymer Science and Technology (Interscience Publisher), Volume 10, under the heading of "Phenolic Resins", the disclosure of which is hereby incorporated by reference herein.

Suitable phenols for preparing the novolak phenol resins include phenol and substituted phenols which have hydrocarbon radicals of from 1 to 35 carbon atoms and/or one or more halogen radicals. Substituted phenols include ortho, meta or para-cresol, ethyl phenol, nonyl phenol, octyl phenol, phenyl phenol, styrenated phenol, isopropenyl phenol, 3-chlorophenol, 3-bromophenol, 3,5-xylenol, 2,4-xylenol, 2,6-xylenol, 3,5-dichlorophenol, 2,4-dichlorophenol, 3-chloro-5-methyl phenol, dichloroxylenol, dibromoxylenol, 2,4,5-trichlorophenol, and 6-phenyl-2-chlorophenol. Mixtures of phenols may be used. Phenols and substituted phenols having hydrocarbon radicals of from one to 35 carbon atoms are preferably employed, with phenol, cresol, t-butyl phenol and nonyl phenol most preferred. Phenol and cresol are preferred for their low cost and hot offset resistance. Substituted phenols such as t-butylphenol and nonyl phenol, are preferred for their capability of reducing the temperature dependence of the charge stability of the toner. Suitable aldehydes for preparing the novolak phenol resins include formalin, paraformaldehyde, trioxane, and hexamethylenetetramine. The number average-molecular weight of the novolak phenol resin is preferably from 300 to 8000, more preferably from 450 to 3000, and most preferably from 400 to 2000.

The polycarboxylic acid component of the resin (B) may be a dicarboxylic acid, tri- or more polybasic carboxylic acid or a mixture thereof. Those polycarboxylic acids described above with regard to the resin (A) may be suitably used for the resin (B).

It is preferred that the polyester resin used as the resin (B) have an acid value of 20 mgKOH/g or less, more preferably 5 mgKOH/g or less for reasons of stability of charging of the toner.

The weight ratio of the resin (A) to the resin (B) should be in the range of 60:40 to 85:15, preferably 70:30 to 80:20, in order to attain desired anti-filming property and pulverizability. The resin (B) preferably has such a molecular weight distribution according to gel permeation chromatography that a main peak thereof is present in a molecular weight higher than that of the main peak of the resin (A) for reasons of anti-filming property. Preferably, the main peak of the resin (B) is present in a peak molecular weight ($M_B$) which is 1.1 to 2.0 times, more preferably 1.15 to 1.7 times, as great as the peak molecular weight ($M_A$) of the resin (A), namely $2M_A \geqq M_B \geqq 1.1M_A$, preferably $1.17M_A \geqq M_B \geqq 1.15M_A$.

From the standpoint of suitable dispersibility of a coloring agent and an additive, such as a charge controlling agent, in the toner, the resin (A) is desired not to be constituted of the same monomer components as those of the resin (B). In other words, the resin (A) is desired not to be very compatible with the resin (B). Thus, it is preferred that a difference in SP value (solubility parameter δ) between the resin (A) and resin (B) is from 0.2 to 1.0. When the difference is quite large, the resin (B) tends to be present on surfaces of toner particles so that the anti-filming property of the toner is deteriorated. On the other hand, too small a difference in SP value adversely affect the dispersibility of the coloring and additive. Insufficient dispersion of the coloring agent within the toner particle results in a reduction of image density and transparency of the image on OHP sheet. Insufficient dispersion of the charge controlling agent will cause filming and a reduction of charge.

The SP value (solubility parameter δ) is defined by the following formula in the Hilderbrand-Scatchard solution theory:

$$\delta=(\Delta E/V)^{1/2}$$

wherein ΔE represents the molar heat of evaporation, V represents the molar volume and ΔE/V represents cohesive energy density. Generally, a change of heat quantity ΔHm caused by mixing is expressed by:

$$\Delta Hm=V(\delta 1-\delta 2)\cdot\Phi 1/\Phi 2$$

where δ1 represents an SP value of the solvent, δ2 represents an SP value of the solute, Φ1 represents a volume fraction of the solvent and Φ2 represents a volume fraction of the solute. The closer is δ1 to δ2, the smaller becomes the heat quantity ΔHm and the smaller becomes the Gibbs free energy. Thus, compatibility increases as the difference in SP value decreases.

The SP value of a resin may be determined from the SP value of a solvent in which the resin is most soluble. When the monomer composition of a given resin is known, the SP value of the resin may be calculated from the monomer composition using the method of Fedor (Polym. Eng. Sci., 14[2] (1974) according to the following formula:

$$SP\ \text{value}=(\Sigma\Delta ei/\Sigma vi)^{1/2}$$

wherein Δei represents the atomic or atomic group heat of evaporation and Δvi represents the atomic or atomic group volume.

The toner of the present invention may contain a charge controlling agent, if desired. Any charge controlling agent generally used in the field of toners for use in electrophotography may be used for the purpose of the present invention. Examples of such charge controlling agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing surfactant, and metallic salts of salicylic acid and derivatives thereof.

The use of a charge control agent containing heavy metals such as chromium, nickel, chromium and mercury, however, has a problem for safety reasons. When the toner is used in a one-component type, non-magnetic developing system, a heavy metal-containing charge controlling agent which is not well compatible with the binder resin is apt to be separated from the toner during the carriage thereof on the developing sleeve. Thus, the use of a resin-type charge controlling agent is thus preferable for reasons of safety, transparency and compatibility with the binder resin. In particular, the use of a resin-type charge controlling agent in conjunction with the above-described specific binder resin provides a toner which can be charged with a sharp distribution of the charging amount, which can be charged in a stable manner for a long period of service and which can give high quality images.

As the resin charge controlling agent, a negatively chargeable charge controlling polymer having monomer components including (1) a sulfonic acid-containing polymerizable monomer, (2) an aromatic monomer having at least one electron-withdrawing group, and (3) an acrylate monomer and/or methacrylate monomer is preferably used.

The sulfonic acid-containing monomer may be an aliphatic sulfonic acid-containing monomer or an aromatic sulfonic acid-containing monomer. Examples of the aliphatic sulfonic acid-containing monomer include alkali metal salts, alkaline earth metal salts, amine salts and quaternary ammonium salts of vinylsulfonic acid, aryl vinylsulfonic acid, 2-acrylamide-2-methyl propane sulfonic acid, perfluorooctane sulfonic acid, methacryloyloxyethylsulfonic acid. Examples of the aromatic sulfonic acid-containing monomers include alkali metal salts, alkaline earth metal salts, amine salts and quaternary ammonium salts of styrenesulfonic acid, sulfophenylacrylamide and sulfophenylitaconimide.

Examples of the aromatic monomers having electron-withdrawing groups, which can be used, include substituted styrenes such as chlorostyrene, dichlorostyrene, bromostyrene, fluorostyrene, nitrostyrene and cyanstyrene; substituted phenyl (meth)acrylates such as chlorophenyl (meth)acrylate, bromophenyl (meth)acrylate, nitrophenyl (meth)acrylate and chlorophenyloxyethyl (meth)acrylate; substituted phenyl (meth)acrylamides such as chlorophenyl (meth)acrylamide, bromophenyl (meth)acrylamide and nitrophenyl (meth)acrylamide; substituted phenyl maleimides such as chlorophenyl maleimide, dichlorophenyl maleimide, nitrophenyl maleimide and nitrochlorophenyl maleimide; substituted phenyl itaconimides such as chlorophenyl itaconimide, dichlorophenyl itaconimide, nitrophenyl itaconimide and nitrochlorophenyl itaconimide; and substituted phenyl vinyl ethers such as chlorophenyl vinyl ether and nitrophenyl vinyl ether. In particular, phenylmaleimides and phenylitaconimides substituted with chlorine atoms or nitro groups are preferable in terms of chargeability and anti-filming property.

Examples of acrylate and/or methacrylate monomers, which may be used, include methyl (meth)acrylate, ethyl (meth)acrylate, propyl (meth)acrylate, n-butyl (meth) acrylate, isobutyl (meth)acrylate, stearyl (meth)acrylate, dodecyl (meth)acrylate and 2-ethylhexyl acrylate. Of these, n-butyl (meth)acrylate and 2-ethylhexyl acrylate are particularly preferable.

Addition of sulfonic acid-containing monomers to the composition of the resin negative charge control agent will increase the negative charging effect of the agent. However, because the agent in this case is hygroscopic, the temperature-humidity stability will decrease, and this is why copolymers of sulfonic-acid containing monomers and aromatic monomers having electron-withdrawing groups are used, as it is generally known. When this charge control agent is used for a toner, while the toner can process a few thousand copies, if the toner is used for a long period of time processing a few ten-thousand copies or more, staining of the developing sleeve and layer-thickness control member and filming of the photoconductor occur, and toner charge stability and maintenance of high image quality will not be sufficient, resulting in low productivity. To compensate for this problem, polyester or polyol resins are used as the full-color toner binder resin for good color development and image strength, and copolymers comprising three kinds of monomers which are (1) sulfonic-acid containing monomers, (2) aromatic monomers having electron-withdrawing groups, and (3) acrylate monomers and/or methacrylate monomers, are used as the resin negative charge control agent. As a result, the electrographic toner which has good chargeability and environmental resistivity over a long period of time; does not cause staining of the development sleeve and layer-thickness control member; is easily formed into a thin layer; can prevent filming of the photosensitive body; maintains high image quality; and has high productivity.

These effects supposedly arise from reasons explained below. By using sulfonic-acid containing monomers in combination with aromatic monomers having electron-withdrawing groups, the negative charging effect is increased. Using acrylate and/or methacrylate monomers in addition to the combination further increases the environmental resisitivity of the charge and increases resin hardness thus improving the grinding property. In addition, staining of the development sleeve and the layer-thickness control member does not occur, and effect of preventing "filming" of the photosensitive body is improved. Further, combining polyester or polyol resin as the full-color toner binder resin, which is preferable in terms of color development and image strength, optimum dispersibility of toner particles is achieved, and the toner having sharp charge distribution can be obtained. When this toner is used, charge stability and high image quality can be achieved over a long period of time.

The amount of the sulfonic acid-containing monomer in the resin charge control agent used for the toner of the invention is preferably between 1 and 30% by weight, more preferably between 2 and 20% by weight. When the amount of the sulfonic acid-containing monomer is less than 1% by weight, build-up of charging and level of charge might not be sufficient and the image tends to be degraded. When the amount of the sulfonic acid-containing monomer is more than 30% by weight, environmental resistivity of the toner charge might decrease and, therefore, the level of charge becomes low when temperature and humidity are high, and becomes high when the temperature and humidity are low. Since the toner charge cannot be made stable, high image quality cannot be achieved sufficiently. Moreover, staining of the development sleeve and layer-thickness control member and filming of the photosensitive body tend to occur, and there arises a problem that the productivity of the toner during the kneading/grinding process decreases.

The amount of the aromatic monomer having one or more electron-withdrawing groups in the resin negative charge control agent is preferably between 1 and 80% by weight, more preferably between 20 and 70% by weight. When the ratio of aromatic monomers having electron-withdrawing groups is less than 1% by weight, the level of charge will not be sufficient, thereby to cause background staining and toner splash. On the other hand, when the ratio is more than 80% by weight, the dispersibility in the toner is low, charge distribution of the toner becomes broad, background staining and toner splash are easily caused, and high image quality cannot be maintained sufficiently.

The amount of the acrylate and/or methacrylate monomers in the resin negative charge control agent is preferably between 10 and 80% by weight, more preferably between 20 and 70% by weight. when the amount is less than 10% by weight, environmental resistivity of the toner cannot be achieved sufficiently, pulverizability during the grinding process in the toner production will not be sufficient, and staining of the development sleeve and layer-thickness control member and filming of the photosensitive body cannot be prevented fully. On the other hand, when the amount is more than 80% by weight, charge build-up and the level of charge will not be sufficient, and this tends to adversely affect the image quality.

The amount of the charge controlling agent is generally 0.1 to 20% by weight, preferably 0.5 to 10% by weight, more preferably 1.0 to 5% by weight, based on the weight of the toner, for reasons of obtaining proper charging characteristics, while minimizing scattering of the toner within the developing device and occurrence of background stain.

As the colorant, any generally known dyes and pigments can be used. Examples of black coloring agent include carbon black, nigrosin dye and iron black. Examples of yellow coloring agent include naphthol yellow S, hansa yellow (10G, 5G, G), cadmium yellow, yellow iron oxide, ocher, chrome yellow, titan yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthracene yellow BGL and isoindolinone yellow. Examples of the red coloring agent include red iron oxide, red lead, vermillion lead, cadmium red cadmium mercury red, antimony vermillion, permanent red 4R, para red, fire red, parachloro ortho nitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeau 5B, toluidine maroon, permanent bordeau F2K, helio bordeau BL, bordeau 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermillion, benzidine orange, perinone orange and oil orange. Examples of the blue coloring agent include cobalt blue, cerulean blue, alkali bluelake, peacock blue lake, victoria blue lake, non-metal phthalocyanine blues phthalocyanine blue, fast sky blue, indanthrene blue (RS, BC), indigo, ultramarine, iron blue, anthraquinone blue, fast violet B, methyl violet lake, cobalt purple, manganese purple, dioxane violet, anthraquinone violet, chromium green, zinc green, chromium oxide, pylidiane, emerald green, pigment green B, naphthol green B, green gold, acid green lake, malachite green lake, phthalocyanine green and anthraquinone green. Other coloring agents include titanium oxide, zinc white, lithopone and mixture thereof. Amount of the coloring agent is generally between 0.1 and 50 parts by weight per 100 parts by weight of the binder resin.

It is preferred that the coloring agent be pre-treated with the binder resin for reasons of uniform dispersion of the coloring agent into the resin and resulting improvement of color density, transparency and chargeability of the toner. Such a pre-treatment may be carried out by kneading 1 to 5 parts by weight of the binder resin with 1 part by weight of the coloring agent, followed by solidification and grinding to obtain a master batch. When two or more coloring agents are used in combination, the pre-treatment may be performed separately for each coloring agent. Alternatively, the coloring agents are first mixed with each other and the resulting mixture is subjected to the pre-treatment.

For the purpose of imparting releasability to the toner, a wax is preferably included therein. The wax preferably has a melting point of 40 to 120° C., more preferably 50 to 110° C. When the melting point is excessively high, low temperature fixability of the toner is unsatisfactory. On the other hand, when the melting point is excessively low, the offset resistance and durability of the toner may degrade. The melting point can be measured using differential scanning calorimetry (DSC). That is, a fusion peak temperature of the DSC curve obtained by heating a few mg of the wax sample at a constant rate of 10° C./min represents the melting point.

The wax may be a solid wax such as paraffin wax, micro wax, rice wax, fatty acid amide wax, fatty acid wax, aliphatic monoketone, fatty acid metallic salt wax, fatty acid ester wax, partially saponified fatty acid ester wax, silicone varnish, higher alcohol or carnauba wax. Further, polyolefin such as low molecular weight polyethylene or polypropylene may also be used. In particular, polyolefins obtained by ring and ball method having a softening point between 70 and 150° C., more preferably 120 to 150° C., are preferably used. The wax is generally used in an amount of between 0.5 and 20 parts by weight per 100 parts by weight of the binder resin.

For the purpose of improving cleansability, i.e. an ability to remove the toner remaining on the photoconductor or the intermediate transfer medium after the transfer step, there may be used metallic salts of fatty acids, such as zinc stearate, calcium stearate and stearic acid, and polymer particles produced by, for example, soap-free emulsion polymerization of polymethyl methacrylate particles and polystyrene particles. The polymer particles having a relatively narrow particle distribution and volume average particle diameter between 0.01 to 1 um are preferably used.

For the purpose of improving fluidity and chargeability of the toner, an external additive such as inorganic powder of a metal oxide may be suitably mixed with toner particles. The inorganic powder may be processed with a particular silane coupling agent, titanate coupling agent, silicone oil, organic acids, or the like, or coated with a particular resin, to increase the hydrophobicity, chargeability, and so on, of the inorganic powder surface if necessary. Examples of the inorganic powder include silicon dioxide (silica), titanium dioxide (titania), aluminium oxide, zincoxide, magnesium oxide, cerium oxide, iron oxide, copper oxide, and tin oxide. In particular, silica particles obtained by substituting the silanol groups with organic groups to increase the hydrophobicity after reacting silica or titanium oxide particles, with organic silicides such as dimethyl dicholorosilane, hexamethyl disilazane or silicone oil, are suitably used.

It is preferred that the external additive comprise first, relatively large particles and second, relatively small particles, for reasons of prevention of burying of the external additive in the toner particles with time which would occur in the case of a single external additive. When two external additives having different particle diameters are used, the larger external additive (first particles) serve as a spacer for the smaller external additive (second particles) so that the second particles are prevented from being buried in the toner particles. Thus, the fluidity of the toner may be maintained for a long period of service.

Preferably, the first particles have from 2 to 5 times as large average particle diameter as that of the second particles. More preferably, the first particles have a BET specific surface area of 30 to 80 $m^2/g$. When the external additive having a larger particle diameter has a BET specific surface area in the above range, various external additives inclusive of surface treated additives may be used for the purpose of the present invention. More preferably, the BET specific surface area of the first particles is in the range of from 40 to 60 $m^2/g$. Too small a surface area below 30 $m^2/g$ is disadvantageous because nonuniformity is likely to occur in images due to a decrease in the fluidity of toner and because scratches on the photoconductor and white spots in images are likely to occur due to separation of the additive from the toner particles.

The amount of the external additive having the larger particle diameters is preferably 0.1 to 5.0 parts by weight, and more preferably 0.8 to 2.0 parts by weight, per 100 parts by weight of the toner. Too small an amount below 0.1 parts by weight causes problems of poor transfer, whereas, too large an amount in excess of 5.0 parts by weight causes separation of the additive from the toner particles, thus leading to the formation of scratches on the photoconductor and white spots in images.

The second particles preferably have a BET specific surface area of 100 to 250 $m^2/g$, more preferably 120 to 200 m2/g, for reasons of suitable fluidity improving effect and prevention of separation from the toner particles. As long as the external additive having a smaller particle diameter has a BET specific surface area in the above range, various external additives inclusive of surface treated additives may be used for the purpose of the present invention.

The external additive composed of the first and second particles is preferably used in an amount of 0.3 to 3 parts by weight, more preferably 0.5 to 1.5 parts by weight, per 100 parts by weight of the toner. When the amount of the external additive is less than 0.3 parts by weight, the effect of the additive cannot be fully exhibited, whereas, when the amount is more than 3 parts by weight, a portion of the additive is apt to be separated from toner particles, thus leading to the problems of formation of scratches on surfaces of the photoconductor, etc. which are brought into frictional contact with the toner.

The toner of the present invention may contain a magnetic material to provide a magnetic toner. The magnetic material may be, for example, iron oxide (e.g. magnetite, ferrite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium. Above all, use of magnetite is preferred. The magnetic particles preferably have a volume average particle diameter of 0.1 to 2 $\mu$m and are preferably used in an amount of 5 to 150 parts by weight per 100 parts by weight of the binder resin of the toner.

The toner of the present invention including the above ingredients can be used in combination with a carrier as a two-component developer or alone as a one-component developer.

When the toner is used as a two-component developer, any conventionally known carrier such as iron powder, ferrite particles, and glass beads can be used. These carrier base particles may be coated with a resin. In this case, any conventionally known resin can be used. Specific examples of the resin include acrylic resins, polycarbon fluoride, polyvinyl chloride, polyvinylidene chloride, phenol resins, polyvinyl acetal and silicon resins. If desired, electrically conductive powder such as a metal powder, carbon black, titanium oxide, tin oixde or zinc oxide, may be incorporated into the resin coating. The conductive powder generally has an average particle diameter f 1 $\mu$m or less for reasons of capability of controlling the conductivity. The carrier base particles generally has an average particle diameter of 10 to 1000 $\mu$m, preferably 30 to 500 $\mu$m. In general, the toner is mixed with the carrier in an amount of 0.5 to 20 parts by weight per 100 parts by weight of the carrier.

The toner of the present invention can be prepared by any conventionally-known method such as a pulverization method in which raw materials of the toner are blended, kneaded, solidified, ground and classified. Side products having undesired sizes and separated from the desired products during the grinding and classifying steps may be recycled to the raw material blending step. The amount of such recycled material is generally 20% by weight or less based on the weight of the fresh raw materials.

As a device for kneading ingredients of the toner, the following kneaders can be appropriately employed: a batch-type two-roll mixer, Banburry's mixer, a continuous single or two-roll extruder such as a KTK type two-axle extruder manufactured by Kobe Steel, Ltd., a TEM type two-axle extruder manufactured by Toshiba Machine Co., Ltd., a two-axle extruder made by KCK Co., Ltd., a PCM type two-axle extruder manufactured by Ikegai Tekko Co., Ltd., a KEX type two-axle extruder manufactured by Kurimoto, Ltd., and a continuous one-axle kneader such as KO-KNEADER manufactured by Buss AG.

The ingredients may be suitably blended using a Henschel mixer or the like before kneading. The kneading should be performed at a temperature near the softening point of the binder resin so as not to cause breakage of the molecular chain of the binder resin. Too high a temperature above the softening point will cause breakage of the molecular chain of the binder resin. The dispersion of the coloring agent, etc. in the binder resin will not sufficiently proceed when the temperature is excessively lower than the softening point.

The thus obtained kneaded mixture is cooled and ground. The grinding may be performed by a combination of a coarse pulverization with a hammer mill, Rotoplex (a grinder manufactured by Hosokawa Micron Co., Ltd.) or the like and succeeding fine pulverization with a jet air pulverizer or a mechanical pulverizer. The ground mixture is classified in a jet flow utilizing tangential force to obtain a toner having an average size of, for example, 5–20 $\mu$m.

The thus obtained toner is, if desired, mixed with an external additive. The mixing with the external additive may be carried out using a conventional mixer preferably capable of controlling the mixing temperature. The external additive may be added gradually or at once. The rotational speed, mixing time and mixing temperature may be varied in any suitable manner. Illustrative of suitable mixers are V-type mixers, rocking mixers, Ledige mixers, nauter mixers and Henschel mixers. The resulting mixture is passed through a sieve of for example 250 mesh or finer to remove large particles and aggregates, thereby obtaining a toner. The toner may be packed in a container together with a carrier as a two-component developer or in a cartridge by itself as a one-component developer.

The following examples and comparative examples will further illustrate the present invention. Parts are by weight.

Synthesis of Resin (A):

SYNTHESIS EXAMPLE 1

In a four-necked flask equipped with a stirrer, a thermometer, a nitrogen feed port and a reflux condenser, 740 g of polyoxypropylene(2,2)-2,2-bis(4-hydroxyphenyl) propane, 300 g of polyoxyethylene(2,2)-2,2-bis(4-hydroxyphenyl)propane, 466 g of dimethyl terephthalate, 80 g of isododecenylsuccinic anhydride and 114 g of tri-n-butyl 1,2,4-benzenetriacetate were charged together with an esterification catalyst. The contents in the flask were reacted at 210° C. for 8 hours in the atmosphere of nitrogen and then at the same temperature for 5 hours with stirring under a reduced pressure. As a consequence, a polyester resin (A-1) having Tg of 62° C., an acid value of 2.3 mgKOH/g, an apparent viscosity of $10^3$ Pa·s at 112° C. and such a molecular weight distribution according to gel permeation chromatography that (a) a main peak is present in a molecular weight region of 7,500, (b) that portion of the polyester resin having a molecular weight of 500 or less accounts for 3.5% based on a total weight of the polyester resin, and (c) the ratio Mw/Mn of the weight average molecular weight to the number average molecular weight is 5.1.

SYNTHESIS EXAMPLE 2

In a four-necked flask equipped with a stirrer, a thermometer, a nitrogen feed port and a reflux condenser, 378.4 g of a low molecular weight bisphenol A epoxy resin (molecular weight: about 360), 86.0 g of a high molecular weight bisphenol A epoxy resin (molecular weight: about 2,700), 191.0 g of glycidylated, propylene oxide adduct of bisphenol A (n+m in the above formula (2) is about 2.1), 274.5 g of bisphenol F, 70.1 g of p-cumylphenol and 200 g of xylene were charged. The contents in the flask were then heated to 70–100° C. in the atmosphere of nitrogen, to which 0.1839 g of lithium chloride was added. The mixture was heated to 160° C. under a reduced pressure to remove xylene. The resulting mixture was then reacted at 180° C. for 6–9 hours. As a consequence, a polyol resin (A-2) having Tg of 58° C., an acid value of 0.0 mgKOH/g, an apparent viscosity of $10^3$ Pa·s at 109° C. and such a molecular weight distribution according to gel permeation chromatography that (a) a main peak is present in a molecular weight region of 8,200, (b) that portion of the polyester resin having a molecular weight of 500 or less accounts for 2.1% based on a total weight of the polyester resin.

SYNTHESIS EXAMPLE 3

In a four-necked flask equipped with a stirrer, a thermometer, a nitrogen feed port and a reflux condenser, 650 g of polyoxypropylene(2,2)-2,2-bis(4-hydroxyphenyl) propane, 650 g of polyoxyethylene(2,2)-2,2-bis(4-hydroxyphenyl)propane, 515 g of isophthalic acid, 70 g of isooctenylsuccinic acid and 80 g of 1,2,4-benzenetriacetic acid were charged together with an esterification catalyst. The contents in the flask were then reacted in the same manner as that in Synthesis Example 1 except that the reaction time was shortened. As a consequence, a polyester resin (A-3) having Tg of 61° C., an acid value of 9.0 mgKOH/g, an apparent viscosity of $10^3$ Pa·s at 117° C. and such a molecular weight distribution according to gel permeation chromatography that (a) a main peak is present in a molecular weight region of 3,500, (b) that portion of the polyester resin having a molecular weight of 500 or less accounts for 2.1% based on a total weight of the polyester resin, and (c) the ratio Mw/Mn of the weight average molecular weight to the number average molecular weight is 2.7.

SYNTHESIS EXAMPLE 4

The reactants as shown in Synthesis Example 3 were reacted in the same manner as that in Synthesis Example 1 to give a polyester resin (A-4) having Tg of 61° C., an acid value of 10.0 mgKOH/g, an apparent viscosity of $10^3$ Pa·s at 117° C. and such a molecular weight distribution according to gel permeation chromatography that (a) a main peak is present in a molecular weight region of 9,200, (b) that portion of the polyester resin having a molecular weight of 500 or less accounts for 2.1% based on a total weight of the polyester resin, and (c) the ratio Mw/Mn of the weight average molecular weight to the number average molecular weight is 4.6.

SYNTHESIS EXAMPLE 5

In a four-necked flask equipped with a stirrer, a thermometer, a nitrogen feed port and a reflux condenser, 714 g of polyoxypropylene(2,2)-2,2-bis(4-hydroxyphenyl) propane, 663 g of polyoxyethylene(2,2)-2,2-bis(4-hydroxyphenyl)propane, 648 g of isophthalic acid and 150 g of isooctenylsuccinic acid were charged together with an esterification catalyst. The contents in the flask were then reacted in the same manner as that in Synthesis Example 1. As a consequence, a polyester resin (A-5) having Tg of 67° C., an acid value of 23.2 mgKOH/g, an apparent viscosity of $10^3$ Pa·s at 126° C. and such a molecular weight distribution according to gel permeation chromatography that (a) a main peak is present in a molecular weight region of 8,500, (b) that portion of the polyester resin having a molecular weight of 500 or less accounts for 4.8% based on a total weight of the polyester resin, and (c) the ratio Mw/Mn of the weight average molecular weight to the number average molecular weight is 8.5.

Synthesis of Resin (B):

SYNTHESIS EXAMPLE 6

In a flask, 750 g of polyoxypropylene(2,2)-2,2-bis(4-hydroxyphenyl)propane, 175 g of polyoxyethylene(2,2)-2,2-bis(4-hydroxyphenyl)propane, 160 g of glycerin and 650 g of dimethyl terephthalate were charged together with an esterification catalyst. The contents in the flask were then reacted in the same manner as that in Synthesis Example 1. As a consequence, a polyester resin (B-1) having Tg of 62° C., an acid value of 3.0 mgKOH/g, an apparent viscosity of $10^3$ Pa·s at 123° C. and such a molecular weight distribution according to gel permeation chromatography that (a) a main peak is present in a molecular weight region of 10,000.

SYNTHESIS EXAMPLE 7

In a flask, 956 g of polyoxypropylene(2,2)-2,2-bis(4-hydroxyphenyl)propane, 175 g of polyoxyethylene(2,2)-2, 2-bis(4-hydroxyphenyl)propane, 160 g of glycerin, 650 g of dimethyl terephthalate, 80 g of dodecenylsuccinic acid and 120 g of 1,2,4-benzenetriacetic acid were charged together with an esterification catalyst. The contents in the flask were then reacted in the same manner as that in Synthesis Example 1. As a consequence, a polyester resin (B-2) having Tg of 64° C., an acid value of 10.1 mgKOH/g, an apparent viscosity of $10^3$ Pa·s at 130° C. and such a molecular weight distribution according to gel permeation chromatography that (a) a main peak is present in a molecular weight region of 9,500.

SYNTHESIS EXAMPLE 8

In a flask, 1,250 g of polyoxypropylene(2,2)-2,2-bis(4-hydroxyphenyl)propane, 650 g of dimethyl terephthalate and 40 g of 1,2,4-benzenetriacetic acid were charged together with an esterification catalyst. The contents in the flask were then reacted in the same manner as that in Synthesis Example 1. As a consequence, a polyester resin (B-3) having Tg of 63° C., an acid value of 5.1 mgKOH/g, an apparent viscosity of $10^3$ Pa·s at 126° C. and such a molecular weight distribution according to gel permeation chromatography that (a) a main peak is present in a molecular weight region of 8,800.

SYNTHESIS EXAMPLE 9

In a flask 300 g of 1,6-hexanediol, 800 g of dimethyl terephthalate and 100 g of 1,2,4-benzenetriacetic acid were charged together with an esterification catalyst. The contents in the flask were then reacted in the same manner as that in Synthesis Example 1. As a consequence, a polyester resin (B-4) having Tg of 60° C., an acid value of 12.1 mgKOH/g, an apparent viscosity of $10^3$ Pa·s at 131° C. and such a molecular weight distribution according to gel permeation chromatography that (a) a main peak is present in a molecular weight region of 9,100.

SYNTHESIS EXAMPLE 10

In a flask, 1,270 g of polyoxyethylene(2,2)-2,2-bis(4-hydroxyphenyl)propane, 650 g of dimethyl terephthalate and 100 g of 1,2,4-benzenetriacetic acid were charged together with an esterification catalyst. The contents in the flask were then reacted in the same manner as that in Synthesis Example 1. As a consequence, a polyester resin (B-5) having Tg of 61° C., an acid value of 8.5 mgKOH/g, an apparent viscosity of $10^3$ Pa·s at 129° C. and such a molecular weight distribution according to gel permeation chromatography that (a) a main peak is present in a molecular weight region of 9,300.

SYNTHESIS EXAMPLE 11

In a flask, 950 g of polyoxyethylene(2,2)-2,2-bis(4-hydroxyphenyl)propane, 160 g of glycerin and 650 g of dimethyl terephthalate were charged together with an esterification catalyst. The contents in the flask were then reacted in the same manner as that in Synthesis Example 1. As a consequence, a polyester resin (B-6) having Tg of 60° C., an acid value of 7.5 mgKOH/g, an apparent viscosity of $10^3$ Pa·s at 124° C. and such a molecular weight distribution according to gel permeation chromatography that (a) a main peak is present in a molecular weight region of 8,900.

SYNTHESIS EXAMPLE 12

In a flask, the same reactants as those used in Synthesis Example 8 were charged together with an esterification catalyst. The contents in the flask were then reacted in the same manner as that in Synthesis Example 3. As a consequence, a polyester resin (B-7) having Tg of 61° C., an acid value of 5.5 mgKOH/g, an apparent viscosity of $10^3$ Pa·s at 123° C. and such a molecular weight distribution according to gel permeation chromatography that (a) a main peak is present in a molecular weight region of 7,000.

Synthesis of Charge Controlling Agent:

SYNTHESIS EXAMPLE 13

600 Parts of 3,4-dichlorophenylmaleimide and 100 parts of perfluorooctanesulfonic acid were copolymerized in dimethylformamide (DMF) under reflux for 8 hours in the presence of di-t-butylperoxide as an initiator. To the reaction mixture, 300 parts of n-butyl acrylate were added and the mixture was reacted in the presence of di-t-butylperoxide as an initiator for 4 hours for the graft polymerization thereof. From the resulting mixture, DMF was removed in a vacuum evaporator to leave a charge controlling resin C-1 having an apparent viscosity of $10^4$ Pa·s at 95° C.

SYNTHESIS EXAMPLE 14

600 Parts of m-nitrophenylmaleimide and 100 parts of 2-acrylamide-2-methylpropanesulfonic acid were copolymerized in dimethylformamide (DMF) under reflux for 8 hours in the presence of di-t-butylperoxide as an initiator. To the reaction mixture, 250 parts of 2-ethylhexyl acrylate were added and the mixture was reacted in the presence of di-t-butylperoxide as an initiator for 4 hours for the graft polymerization thereof. From the resulting mixture, DMF was removed in a vacuum evaporator to leave a charge controlling resin C-2 having an apparent viscosity of $10^4$ Pa·s at 82° C.

SYNTHESIS EXAMPLE 15

400 Parts of 3,4-dichlorophenylmaleimide and 100 parts of 2-acrylamide-2-methylpropanesulfonic acid were copolymerized in dimethylformamide (DMF) under reflux for 8 hours in the presence of di-t-butylperoxide as an initiator. From the resulting mixture, DMF was removed in a vacuum evaporator to leave a charge controlling resin C-3 having a number average molecular weight of 7,000.

SYNTHESIS EXAMPLE 16

100 Parts of 2-acrylamide-2-methylpropanesulfonic acid, 250 parts of 2-ethylhexyl acrylate and 700 parts of a styrene monomer were copolymerized in dimethylformamide (DMF) under reflux for 4 hours in the presence of di-t-butylperoxide as an initiator. From the resulting mixture, DMF was removed in a vacuum evaporator to leave a charge controlling resin C-4 having an apparent viscosity of $10^4$ Pa·s at 95° C.

Preparation of Toners:

| | |
|---|---|
| Resin A-1 | 80 parts |
| Resin B-2 | 20 parts |
| C. I. Pigment Blue 15, 3 | 5 parts |
| Charge controlling agent (Bontron PB E-84) | 3 parts |
| Low molecular weight polypropylene | 5 parts |

The above ingredients were mixed with a Henschel mixer and then melt-kneaded in a double-roll mixer for 30 minutes. The surface temperature of each of the two rolls was adjusted to 100° C. The kneaded mixture was rolled, cooled, coarsely pulverized, followed by grinding with a collision board type jet mill grinder (I-2 Type Mill, manufactured by Nippon Pneumatic Mfg. Co. Ltd.) and air-classification with a vortex classifier (DS Classifier, manufactured by Nippon Pneumatic Mfg. Co. Ltd.), thereby obtaining blue toner particles having a volume average particle size of 7.0 μm and 9.8% by number of particles having a particle diameter of 4 μm or less. The toner particles were mixed with 0.8% by weight (based on the weight of the toner particles) of hydrophobic silica (H2000 manufactured by Clariant Japan Inc.; BET specific surface area: 120 $m^2/g$) as an external additive to obtain a toner.

EXAMPLES 2–15 AND COMPARATIVE EXAMPLES 1–9

Example 1 was repeated in the same manner as described except that the kind and amount of the binder resin, the kind of the charge controlling agent, and/or the kind and amount of the external additive were changed as summarized in Table 1, thereby obtaining various toners. In Table 1, external additives RX50, RY50, NX90, H3004 and H1303 represent as follows:

RX50: hydrophobic silica (RX-50 manufactured by Nippon Aerosil Inc., BET specific surface area: 50 $m^2/g$)

RY50: hydrophobic silica (RY-50 manufactured by Nippon Aerosil Inc., BET specific surface area: 50 $m^2/g$)

NX90: hydrophobic silica (NX-90 manufactured by Nippon Aerosil Inc., BET specific surface area: 90 $m^2/g$)

H3004: hydrophobic silica (H3004 manufactured by Clariant Japan Inc., BET specific surface area: 200 $m^2/g$)

H1303: hydrophobic silica ($H_{1303}VP$ manufactured by Clariant Japan Inc., BET specific surface area: 120 $m^2/g$)

TABLE 1

| | Binder Resin A | | Binder Resin B | | Charge | External additive | | External additive | |
|---|---|---|---|---|---|---|---|---|---|
| Example | kind | amount | kind | amount | controlling agent | kind | amount | kind | amount |
| 1 | A-1 | 80 | B-2 | 20 | E-84 | H2000 | 0.8 | — | 0 |
| 2 | A-1 | 60 | B-2 | 40 | E-84 | H2000 | 0.8 | — | 0 |
| 3 | A-2 | 70 | B-2 | 30 | E-84 | H2000 | 0.8 | — | 0 |
| 4 | A-3 | 70 | B-2 | 30 | E-84 | H2000 | 0.8 | — | 0 |
| 5 | A-2 | 70 | B-1 | 30 | E-84 | H2000 | 0.8 | — | 0 |
| 6 | A-2 | 70 | B-3 | 30 | E-84 | H2000 | 0.8 | — | 0 |
| 7 | A-2 | 50 | B-7 | 50 | E-84 | H2000 | 0.8 | — | 0 |
| 8 | A-2 | 70 | B-2 | 30 | C-1 | H2000 | 0.8 | — | 0 |
| 9 | A-2 | 70 | B-2 | 30 | C-2 | H2000 | 0.8 | — | 0 |
| 10 | A-2 | 70 | B-2 | 30 | C-3 | H2000 | 0.8 | — | 0 |
| 11 | A-2 | 70 | B-2 | 30 | C-4 | H2000 | 0.8 | — | 0 |
| 12 | A-2 | 70 | B-2 | 30 | C-2 | H2000 | 0.8 | RX50 | 1.0 |
| 13 | A-2 | 70 | B-2 | 30 | C-2 | H2000 | 0.8 | RY50 | 2.0 |
| 14 | A-2 | 70 | B-2 | 30 | C-2 | H1303 | 0.8 | NX90 | 1.0 |
| 15 | A-2 | 70 | B-2 | 30 | C-2 | H3004 | 0.8 | H1303 | 2.0 |
| Comp. 1 | A-1 | 50 | B-2 | 50 | E-84 | H2000 | 0.8 | — | 0 |
| Comp. 2 | A-1 | 90 | B-2 | 10 | E-84 | H2000 | 0.8 | — | 0 |
| Comp. 3 | A-2 | 70 | B-4 | 30 | E-84 | H2000 | 0.8 | — | 0 |
| Comp. 4 | A-2 | 70 | B-5 | 30 | E-84 | H2000 | 0.8 | — | 0 |
| Comp. 5 | A-2 | 70 | B-6 | 30 | E-84 | H2000 | 0.8 | — | 0 |
| Comp. 6 | A-4 | 70 | B-2 | 30 | E-84 | H2000 | 0.8 | — | 0 |
| Comp. 7 | A-5 | 70 | B-2 | 30 | E-84 | H2000 | 0.8 | — | 0 |
| Comp. 8 | A-1 | 100 | — | 0 | E-84 | H2000 | 0.8 | — | 0 |
| Comp. 9 | A-1 | 50 | B-2 | 50 | E-84 | H2000 | 0.8 | RX50 | 1.0 |

Evaluation of Toner:

1. Pulverizability:

During the preparation of toners, coarsely ground toner particles are sampled in each of Examples and Comparative Examples. Each sample is pulverized using a collision board type jet mill grinder (I-2 Type Mill, manufactured by Nippon Pneumatic Mfg. Co. Ltd.) under a given condition. The ground sample is measured for the weight average particle diameter. The pulverizability of a given sample is represented by a ratio (Dn/D1) of the weight average particle diameter Dn of the given sample to the weight average particle diameter D1 of the ground sample of Example 1. The smaller the ratio, the better is the pulverizability. Pulverizability of more than 1.3 is regarded as being no good and poses a problem in pulverizing efficiency.

2. Fixability

A full color laser printer (Ipsio color 5000 manufactured by Ricoh Company, Ltd.) was modified such that the fixing temperature was able to be changed. The printer was provided with a non-magnetic, one-component type developing unit including a developing sleeve having a surface coated elastic layer, and a stainless blade for adjusting the thickness of the toner layer formed on the surface of the sleeve.

Using the above machine and papers (Type 6200 manufactured by Ricoh Company, Ltd.), copying test was conducted such that the basis weight of the toner image on each paper was 80 $g/cm^2$. The fixing temperature was gradually increased to determine the temperature at which cold offset occurred and the temperature at which hot offset occurred. The fixability is represented by a difference between the temperature at which cold offset occurs and the temperature at which hot offset occurs. The larger the difference, the better is the fixability, i.e. the toner can be said to be developable in a wide temperature range without causing offset problems. When the difference is less than 50° C., the fixability is no good.

3. Image Quality

The above full color laser printer (Ipsio color 5000 manufactured by Ricoh Company, Ltd.) was modified such that a fresh toner was able to be replenished by exchange of toner cartridge. An image chart having an image area of 5% was reproduced to give 10,000 copies. The toner cartridge was then exchanged with new one containing fresh toner and image reproduction was carried out for another 10,000 copies (20,000 runs). Such cartridge exchange and image reproduction were repeated so that 50,000 copies were produced in total (50,000 runs). After replacing the image chart with white paper (image area: 0%), copying operation was conducted to obtain 30,000 additional copies (80,000 runs) without exchanging the toner cartridge. The toner cartridge was then exchanged with new one containing fresh toner and image reproduction was carried out. Image quality was evaluated in terms of charging amount, background stain and filming as follows.

3.1 Charging Amount:

A sample toner was transferred on the developing sleeve. The triboelectricity (unit: $-\mu C/g$) was measured by evacuation method.

3.2 Background Stain:

The measurement of background stain was carried out immediately after 10,000, 50,000 and 80,000 runs and immediately after the exchange of the toner cartridge after the 80,000 runs. Thus, the photoconductor was exposed to a white image and the electrostatic latent image was subjected to a developing treatment. The developed image was transferred to a transfer tape and the image density of the tape was measured using a spectrodensitometer (Model 938 produced by X-Rite, Inc.). A difference in image density between the transfer tape and a control tape which had not been subjected to the transfer of the white image represents the background stain. The greater the difference, the larger becomes the amount of the toner on the white image, i.e. the greater becomes the background stain.

3.3 Filming:

After 50,000 and 80,000 runs, the surfaces of the developing sleeve, stainless blade and photoconductor were observed to examine whether toner filming occurred. Evaluation is rated as follows:

A: no filming is found

B: streaks of toner filming are found

C: toner filming occurs on entire surface

The results of the charging amount, background stain and filming tests are summarized in Tables 2-1 and 2-2. The image quality after the 50,000 and 80,000 runs and after toner replenishment following the 80,000 runs was also evaluated on the basis of the results of the charging amount, background stain and filming tests. Further, overall evaluation was made on the basis of the results of the pulverizability, fixability and image quality evaluation. The evaluation was rated as follows:

A: Excellent

B: Good

C: Fair

D: Poor

In Tables 2-1 and 2-2, the asterisk (*) indicates that the test was no longer carried out because the test result after the 10,000 runs was poor or because the evaluation after the 50,000 runs or 80,000 runs showed rank D.

TABLE 2-1

| | | | 10,000 runs | | 50,000 runs | | | |
|---|---|---|---|---|---|---|---|---|
| Example | Pulverizability | Fixability | Charging amount | Background stain | Charging amount | Background stain | Filming | Total evaluation |
| 1 | 1.00 | 55 | 20.3 | 0.01 | 20.7 | 0.01 | A | A |
| 2 | 0.79 | 60 | 22.5 | 0.01 | 21.8 | 0.02 | A | A |
| 3 | 0.93 | 60 | 23.5 | 0.01 | 23.7 | 0.01 | A | A |
| 4 | 0.71 | 60 | 25.1 | 0.01 | 19.5 | 0.03 | A | B |
| 5 | 1.29 | 60 | 21.1 | 0.01 | 19.3 | 0.02 | A | B |
| 6 | 0.93 | 60 | 22.2 | 0.01 | 18.8 | 0.03 | A | B |
| 7 | 0.86 | 50 | 22.6 | 0.02 | 16.7 | 0.03 | A | B |
| 8 | 0.99 | 60 | 20.5 | 0.01 | 19.5 | 0.01 | A | A |
| 9 | 0.95 | 60 | 23.1 | 0.01 | 21.5 | 0.01 | A | A |
| 10 | 0.93 | 60 | 20.8 | 0.01 | 21.2 | 0.01 | A | A |
| 11 | 0.96 | 60 | 24.5 | 0.01 | 25.0 | 0.02 | A | A |
| 12 | 0.95 | 60 | 25.0 | 0.01 | 23.3 | 0.01 | A | A |
| 13 | 0.95 | 60 | 23.0 | 0.01 | 24.1 | 0.01 | A | A |
| 14 | 0.95 | 60 | 24.0 | 0.01 | 23.5 | 0.01 | A | A |
| 15 | 0.95 | 60 | 25.3 | 0.01 | 24.5 | 0.01 | A | A |
| Comp. 1 | 0.71 | 60 | 23.1 | 0.01 | 15.3 | 0.05 | C | D |
| Comp. 2 | 1.57 | 50 | 19.5 | 0.01 | 20.0 | 0.01 | A | D |
| Comp. 3 | 0.71 | 60 | 15.1 | 0.10 | * | * | C | D |
| Comp. 4 | 1.57 | 60 | 18.8 | 0.02 | 19.9 | 0.02 | A | D |
| Comp. 5 | 1.43 | 60 | 17.8 | 0.03 | 17.8 | 0.03 | A | D |
| Comp. 6 | 1.43 | 60 | 20.1 | 0.01 | 19.9 | 0.01 | A | D |
| Comp. 7 | 1.29 | 60 | 19.1 | 0.01 | 12.3 | 0.09 | C | D |
| Comp. 8 | 2.14 | 40 | 18.8 | 0.01 | 19.1 | 0.01 | A | D |
| Comp. 9 | 0.71 | 60 | 23.2 | 0.01 | 17.5 | 0.03 | B | C |

TABLE 2-2

| | 80,000 runs | | | | After toner replenishment | | |
|---|---|---|---|---|---|---|---|
| Example | Charging amount | Background stain | Filming | Total evaluation | Background stain | Total evaluation | Overall evaluation |
| 1 | 17.3 | 0.02 | B | B | 0.05 | C | B |
| 2 | 15.1 | 0.03 | B | B | 0.05 | C | B |
| 3 | 16.3 | 0.03 | B | B | 0.04 | C | B |
| 4 | 13.7 | 0.05 | B | C | 0.08 | C | C |
| 5 | 14.1 | 0.04 | B | C | 0.06 | C | C |
| 6 | 14.7 | 0.05 | B | C | 0.07 | C | C |
| 7 | 13.1 | 0.06 | B | C | 0.08 | C | C |

TABLE 2-2-continued

| | 80,000 runs | | | | After toner replenishment | | |
|---|---|---|---|---|---|---|---|
| Example | Charging amount | Background stain | Filming | Total evaluation | Background stain | Total evaluation | Overall evaluation |
| 8 | 18.1 | 0.01 | A | A | 0.05 | C | B |
| 9 | 19.9 | 0.02 | A | A | 0.05 | C | B |
| 10 | 17.5 | 0.02 | A | B | 0.06 | C | B |
| 11 | 17.1 | 0.02 | A | B | 0.05 | C | B |
| 12 | 22.4 | 0 | A | A | 0.01 | A | A |
| 13 | 22.2 | 0.01 | A | A | 0.01 | A | A |
| 14 | 21.3 | 0.02 | A | A | 0.03 | B | B |
| 15 | 22.5 | 0.01 | A | A | 0.04 | B | B |
| Comp. 1 | * | * | * | * | * | * | D |
| Comp. 2 | * | * | * | * | * | * | D |
| Comp. 3 | * | * | * | * | * | * | D |
| Comp. 4 | * | * | * | * | * | * | D |
| Comp. 5 | * | * | * | * | * | * | D |
| Comp. 6 | * | * | * | * | * | * | D |
| Comp. 7 | * | * | * | * | * | * | D |
| Comp. 8 | * | * | * | * | * | * | D |
| Comp. 9 | 16.3 | 0.09 | C | D | * | * | D |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2002-276326, filed Sep. 20, 2002, inclusive of the specification, claims and drawings, are hereby incorporated by reference herein.

What is claimed is:

1. A toner for developing an electrostatic latent image, comprising a hinder resin and a colorant, wherein said binder resin comprises different two resins (A) and (B), said resin (A) being substantially free of tetrahydrofuran insolubles, being selected from the group consisting of polyester resins and polyol resins and having such a molecular weight distribution according to gel permeation chromatography that (a) a main peak is present in a molecular weight of 3000 to 9,000 and (b) that portion of said resin (A) having a molecular weight of 500 or less accounts for 4 % or less based on a total weight of said resin (A), said resin (B) being substantially free of tetrahydrofuran insolubles and being a polyester resin containing a dial component represented by the formula (1):

(1)

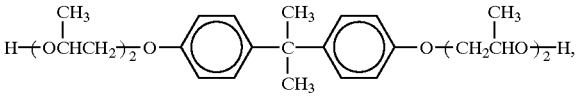

wherein the weight ratio of said resin (A) to said resin (B) is in the range of 60:40 to 85:15.

2. A toner as claimed in claim 1, wherein said resin (B) has such a molecular weight distribution according to gel permeation chromatography that a main peak is present in a molecular weight higher than that of said main peak of said resin (A).

3. A toner as claimed in claim 2, wherein the main peak molecular weight of said resin (B) is 1.1 to 2.0 times as high as that of said resin (A).

4. A toner as claimed in claim 1, further comprising a charge controlling agent.

5. A toner as claimed in claim 4, wherein said charge controlling agent is a negatively chargeable polymer having monomer components of (a) a polymerizable monomer having a sulfonic acid salt, (b) a phenylmaleimide in which the phenyl group is substituted with at least one electron attracting groups selected from a chlorine atom and a nitro group, or a phenylitaconimide in which the phenyl group is substituted with at least one electron attracting groups selected from a chlorine atom and a nitro group, and (c) an acrylate, a methacrylate and/or an aromatic vinyl compound.

6. A toner as claimed in claim 5, wherein said negatively chargeable polymer has a content of the monomer component (a) in the range of 1 to 30 % by weight, a content of the monomer component (b) in the range of 1 to 80 % by weight, a content of the acrylate and methacrylate in the range of 10 to 80 % by weight, and a content of the aromatic vinyl compound in the range of 0 to 30 % by weight.

7. A toner as claimed in claim 1, further comprising an external additive.

8. A toner as claimed in claim 7, wherein said external additive comprises first and second particles having different particle sizes.

9. A toner as claimed in claim 8, wherein said first particles have a BET specific surface area of 30 to 80 $m^2/g$.

10. A toner as claimed in claim 9, wherein said second particles have a BET specific surface area of 100 to 250 $m^2/g$.

11. A toner cartridge containing a toner according to claim 1.

12. An image forming method, comprising developing an electrostatic latent image on an latent image-bearing member with a toner according to claim 1 without using a carrier, said toner being non-magnetic in nature.

* * * * *